US005335699A

United States Patent [19]

Beyaert et al.

[11] Patent Number: 5,335,699

[45] Date of Patent: Aug. 9, 1994

[54] HEIGHT ADJUSTING DEVICE FOR WEAVING DEVICE FOR MACHINE HARNESS ELEMENTS

[75] Inventors: Daniel Beyaert, Wijtschate-Heuvelland; Ignace Meyns, Reninge; Dirk Sampers, Oostvleteren; Michel Vandeweghe, Wijtschate-Heuvelland, all of Belgium

[73] Assignee: Picanol N.V., naamloze vennootschap, Belgium

[21] Appl. No.: 904,657

[22] Filed: Jun. 26, 1992

[30] Foreign Application Priority Data

Jun. 26, 1991 [BE] Belgium ..... 09100613

[51] Int. Cl.[5] ..... D03C 13/00; D03C 9/06

[52] U.S. Cl. ..... 139/82; 139/91

[58] Field of Search ..... 139/91, 82, 88, 57, 139/58

[56] References Cited

U.S. PATENT DOCUMENTS

| | | | |
|---|---|---|---|
| 3,888,284 | 6/1975 | Tiernan et al. . | |
| 4,644,979 | 2/1987 | Senn et al. | 139/82 |
| 4,877,060 | 10/1989 | Froment et al. | 139/82 |

FOREIGN PATENT DOCUMENTS

| | | | |
|---|---|---|---|
| 903190 | 3/1986 | Belgium . | |
| 0242668 | 4/1987 | European Pat. Off. . | |
| 1166108 | 3/1964 | Fed. Rep. of Germany . | |
| 970624 | 1/1951 | France . | |
| 1033130 | 1/1953 | France . | |
| 1507993 | 12/1967 | France . | |
| 2267401 | 11/1975 | France . | |
| 91/10763 | 7/1991 | PCT Int'l Appl. | 139/82 |
| 549668 | 5/1974 | Switzerland . | |
| 661065 | 9/1983 | Switzerland . | |

*Primary Examiner*—Andrew M. Falik

*Attorney, Agent, or Firm*—Bacon & Thomas

[57] ABSTRACT

A device for forming a shed in weaving machines includes a harness and coupling elements for coupling the harness to a drive mechanism. The height of the harnesses is made adjustable by mounting respective coupling elements on setting screws integrated into the side beams of the harness elements and movable relative to the side beams for enabling individual height adjustment of each harness element relative to its coupling element. Because the height adjustment is done on the harness itself, the height adjustment can be done when the harness is inside as well as outside the weaving machine. The setting screws extend through the side beams to the coupling elements, which are situated below the harness, adjustment being effected by turning the screws from the top of the side beams to move of the harness up and down relative to the ends of the setting screws and coupling elements coupled thereto at the bottom of the side beams.

13 Claims, 4 Drawing Sheets

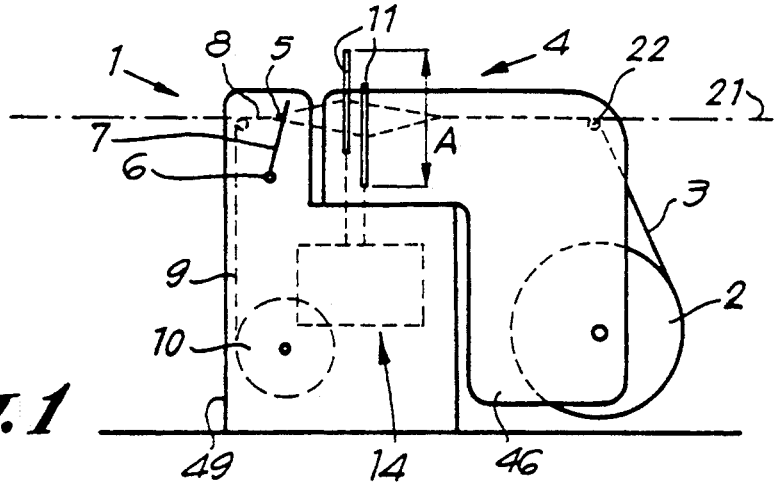
Fig. 1
Fig. 2
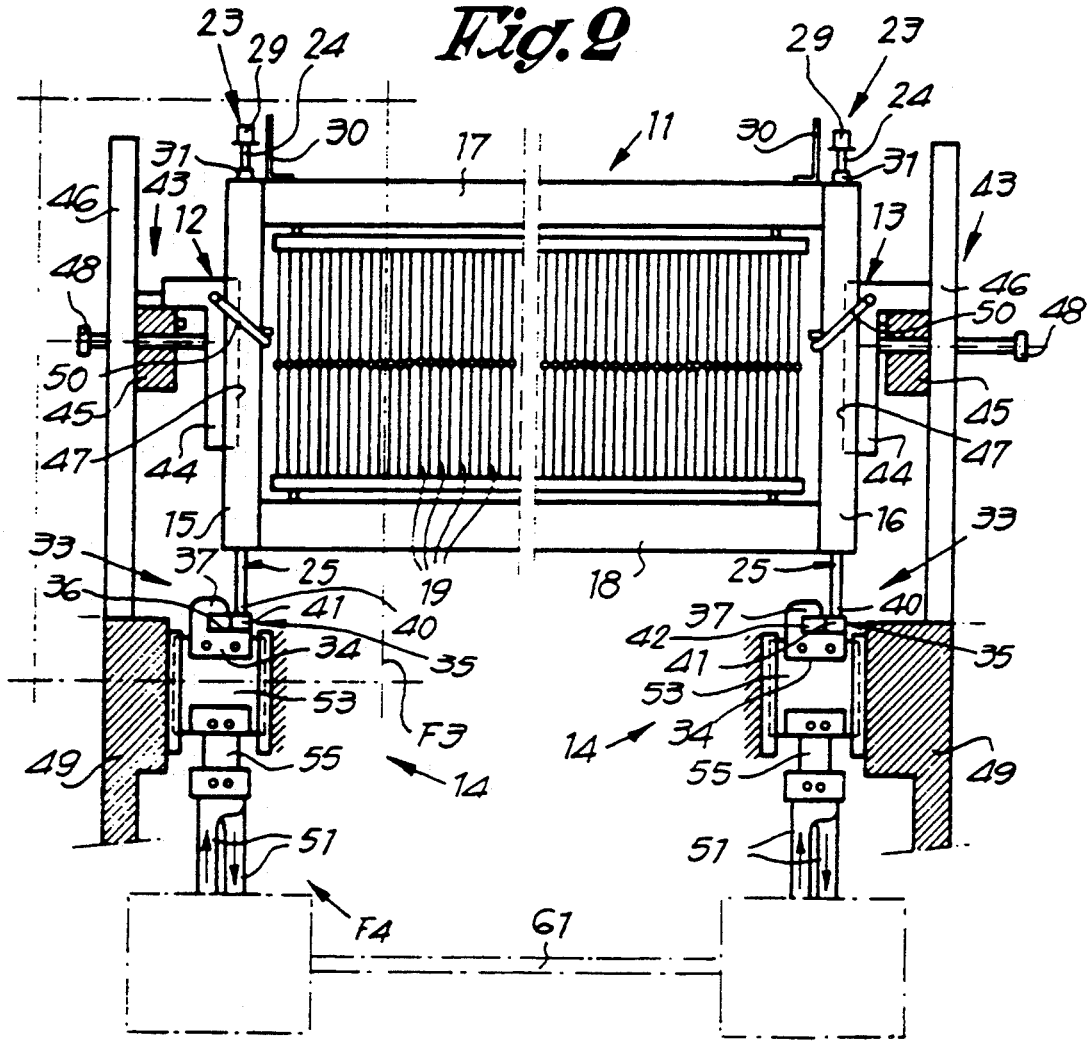

HEIGHT ADJUSTING DEVICE FOR WEAVING DEVICE FOR MACHINE HARNESS ELEMENTS

BACKGROUND OF THE INVENTION

1. Field of the Invention

This invention concerns a device for forming a shed in weaving machines, in particular of the type which consists of harnesses and drive means to move the harnesses to and fro.

2. Description of Related Art

In the case where a method and a device are applied as described in Belgian patent No. 903.190, whereby a part of the weaving machine is replaced in order to change an article, the present invention offers the advantage that such a change of an article can be carried out even faster.

SUMMARY OF THE INVENTION

An objective of the invention is to provide a device which allows height adjustment of the harnesses in relation to their drive means to be carried out in a simple manner.

Another objective of the invention is to provide a device which allows that the harnesses can be coupled and uncoupled in relation to their drive means in a simple and fast manner, such that the harnesses can be easily dismounted.

Another objective of the invention is to provide a device whereby the drive means for the harnesses can be mounted in such a way that they do not obstruct the insertion of the cloth roll deeper into the weaving machine, which provides considerable space saving.

Another objective of the invention is to provide a device which allows the harnesses to be mounted very close to one another, so that not only the above-mentioned drive means but also the harnesses can be built into a limited space.

To this end the invention provides a device for forming a shed, consisting of a harness and accompanying coupling elements to couple the harness to the drive means and, characterized in that it is provided with setting means at the side beams of the harness which allow for an individual setting of the harness in relation to its coupling elements.

By permitting the height adjustment to be done on the harness itself, offers the advantage that the height adjustment can be done when the harness is inside as well as outside the weaving machine.

Preferably, these setting means consist of setting screws which have been integrated into the side beams of the harnesses and which are accessible at their tops to do a setting.

As these setting means are mounted at the height of the side beams, they do not occupy any additional space and they are easily accessible.

Preferably, the device is also provided with coupling means which allow to coupling and uncoupling of the harnesses to the drive means in a simple way.

BRIEF DESCRIPTION OF THE DRAWINGS

In order to better explain the characteristics of the invention, by way of example only and without being limitative in any way, the following preferred embodiment is described below with reference to the accompanying drawings, where:

FIG. 1 shows a schematic representation of a weaving machine;

FIG. 2 shows a schematic representation of a device according to the invention;

DETAILED DESCRIPTION OF THE PREFERRED EMBODIMENTS

Figure 3:
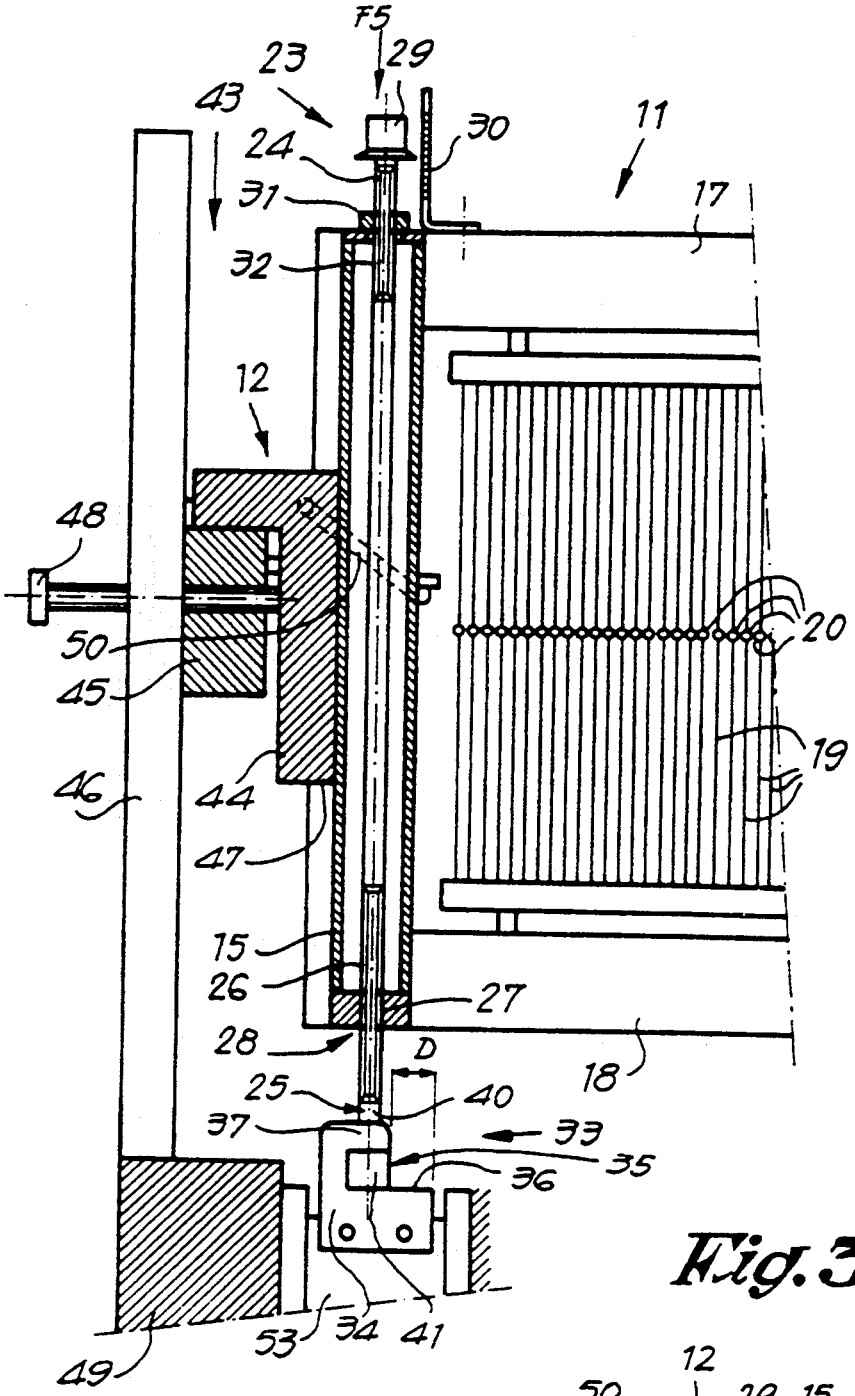
FIG. 3 shows a view of the part indicated in FIG. 2 by F3, to a larger scale and partly in cross-section.
Figure 5:
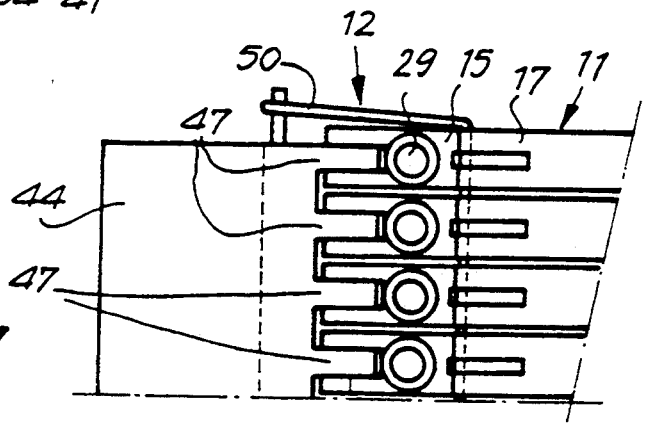
FIG. 5 shows a view according to arrow F5 in FIG. 3.

In order to illustrate the invention, FIG. 1 shows a schematic representation of a weaving machine in which a number of parts have been indicated, such as the frame 1, the warp beam 2, the warp threads 3, the device 4 for forming the shed 5, the sley 6 with the reed 7 in order to strike the weft threads inserted in the shed 5 against the cloth line 8, the weave 9 and the cloth beam 10 to wind the weave 9.

As is known and as shown in FIGS. 1 and 2, the above-mentioned device 4 mainly consists of at least two harnesses 11, guide pieces 12 and 13 along which the harnesses 11 can be moved, and drive means 14 to move the harnesses 11 to and fro, usually up and down.

The harnesses 11 consist of side beams 15 and 16 which are connected by a top beam 17 and a bottom beam 18. In each harness 11 a number of heddles 19 are mounted which are each provided with a thread eye 20 through which a warp thread 3 is guided.

In certain applications it is desirable to move the path A over which the harnesses are moved to and fro by adjusting the height of the harnesses relative to the drive.

This is the case for example when the weaving surface 21, which is horizontal in FIG. 1, is slanted by moving the back rest 22 up or down. This is also the case for special weaving techniques whereby the middle of the path A may not coincide with the weaving surface 21. In order to realize this, a height adjustment of the harnesses 11 is necessary.

According to the invention, use is made to this end of a device 4 for forming the shed 5 which has the characteristic that at the height of the side beams 15 and 16 of the harnesses 11, setting means 23 are provided which allow for an individual, preferably continuous, height adjustment of the harnesses 11 in relation to their drive means 14, in particular in relation to the coupling elements described below by which the harnesses 11 are coupled to the drive means 14.

As shown in FIGS. 2 and 3, these setting means 23 preferably consist of setting screws 24, such that by turning these setting screws 24 the harnesses 11 can be set higher or lower.

Setting screws 24 are preferably integrated in the side beams 15 and 16. In the example shown the setting screws 24 consist of rods which go through the side beams 15 and 16, which are coupled to the drive means 14 at their lower ends 25 in a freely turnable manner, and which are provided with a screw thread 26 which cooperates with the screw thread 27 in a bore hole 28 in the underside of the side beam 15 or 16 concerned.

Each setting screw 24 is accessible at the top of the harnesses 11 and is provided with an element 29 which allows an operator to turn the setting screw 24, such as a rotary button or a knob into which a key or device similar fits. The height adjustment can be read from a scale 30 which is mounted next to each element 29.

As a result, height adjustment of the harness is possible when the harness is inside as well as outside the weaving machine.

In order to lock the harnesses in relation to the setting screws 24, each setting screw 24 is also provided with a lock nut 31 which cooperates with a screw thread part 32 and which can be tightened against the top of the side beam 15 or 16 concerned. Between the side beam 15 or 16 and the lock nut 31 a joint in the shape of a washer can be provided.

According to the invention, coupling means 33 which allow the harnesses 11 to be detached from the drive means 14 are provided preferably on either side underneath the side beams 15 and 16. The coupling means 33 are designed such that the harnesses 11, when being mounted, can first be put down and then coupled to the drive means 14 by a shift sideways.

Figure 4:
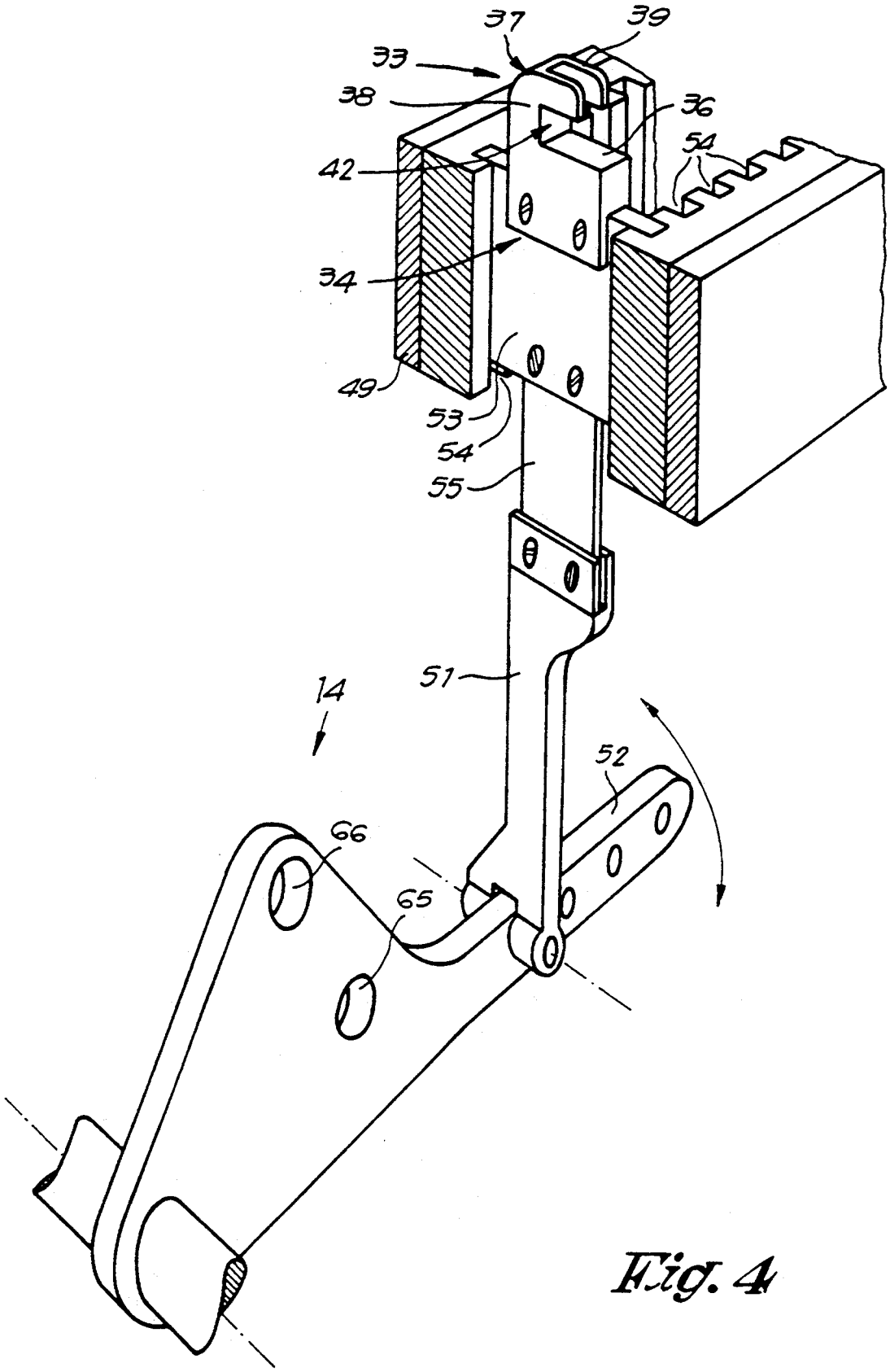
FIG. 4 shows a view of the part indicated in FIG. 2 by F4, in perspective.

To this end the coupling means 33 mainly consist, as shown in FIGS. 2 to 4, of a first coupling element 34 which is fixed to the drive means 14 and a second coupling element 35 which is connected to the harness 11 concerned and which can act upon the first coupling element 34.

As shown in FIG. 4, each first coupling element 34 has a supporting plane 36 and a hook 37. The hook 37 is formed by an upright part 38 and a fork-shaped part 39 running parallel to the supporting plane 36. As shown in FIG. 3, the supporting plane 36 is longer than the above-mentioned part 39, namely over the indicated distance D.

The second coupling element 35 mainly consists of a first part 40 formed by the end 25 of the setting screw 24 concerned, which fits into the fork-shaped part 39 and a second part 41 which is connected to the first part 40 and which has the shape of a broadened head which fits into the opening 42 of the above-mentioned hook 37 and acts upon the back of the teeth of the fork-shaped part 39.

According to a variant, the parts 40 and 41 may be formed of an element which is fixed to the ends 25 of the setting screws 24.

As shown in FIG. 2, the hook-shaped parts 39 on either the right and left side of the harnesses 11 are pointed towards the same side, such that the harnesses 11 with the second coupling element 35 can be lowered onto the supporting planes 36 and coupled to the first coupling elements 34 by a sideways shift.

FIG. 2 shows the situation whereby the harnesses 11 have just been lowered, but not yet coupled. FIG. 3 shows the situation whereby the harnesses 11 are coupled to the drive means 14.

It is clear that the device according to the invention is hereby also provided with means 43 which allow the harnesses 11 to be moved sideways. To this end the above-mentioned guide pieces 12 and 13 have guide elements 44 for the harnesses 11 which are in turn mounted into guide pieces 45 which form a portion of part 46 of the frame 1. The guide elements 44 have ribs 47 which fit into grooves in the edges of the side beams 15 and 16. The guide elements 44 can be moved sideways and positioned in relation to the part 46 of the frame 1, for example by means of adjusting means 48 mounted on either side of the harnesses 11.

The above-mentioned construction is very advantageous in weaving machines which, as described in Belgian patent No. 903.190, have a frame 1 which, as is also indicated in the present FIGS. 1 and 2, consists of a fixed part 49 and a detachable part 46, whereby in the detachable part 46 at least the harnesses and the warp beam 2 are mounted. When the above-mentioned part 46 is removed, according to the present invention, the harnesses can be uncoupled from the drive means 14 in a very simple manner by moving them sideways. In order to prevent the harnesses 11 from falling out of the guide elements 44 when the part 46 of the frame 1 is lifted, locking elements 50 can be mounted between the guide elements 44 and the harnesses 11, such as cables which hold the harnesses 11.

As shown in FIGS. 2 and 4, the drive means 14 have elements 51 which are moved up and down by means of lever arms 52 driven to and fro. The elements 51 are at their top end connected to a part 53 which can be moved in guide pieces 54. By the turning of the lever arms 52 the elements 51 make an arched shift at their bottom ends, changing the angle between the elements 51 and the parts 53. In order to compensate for this change of angle an elastically bendable leaf 55, for example a leaf spring, is provided between the elements 51 and the parts 53. The use of such leaves 55 has the advantage that, contrary to the use of hinge clutches, the elements 51 remain very narrow and the harnesses 11 can be mounted very close to one another.

Figure 6:
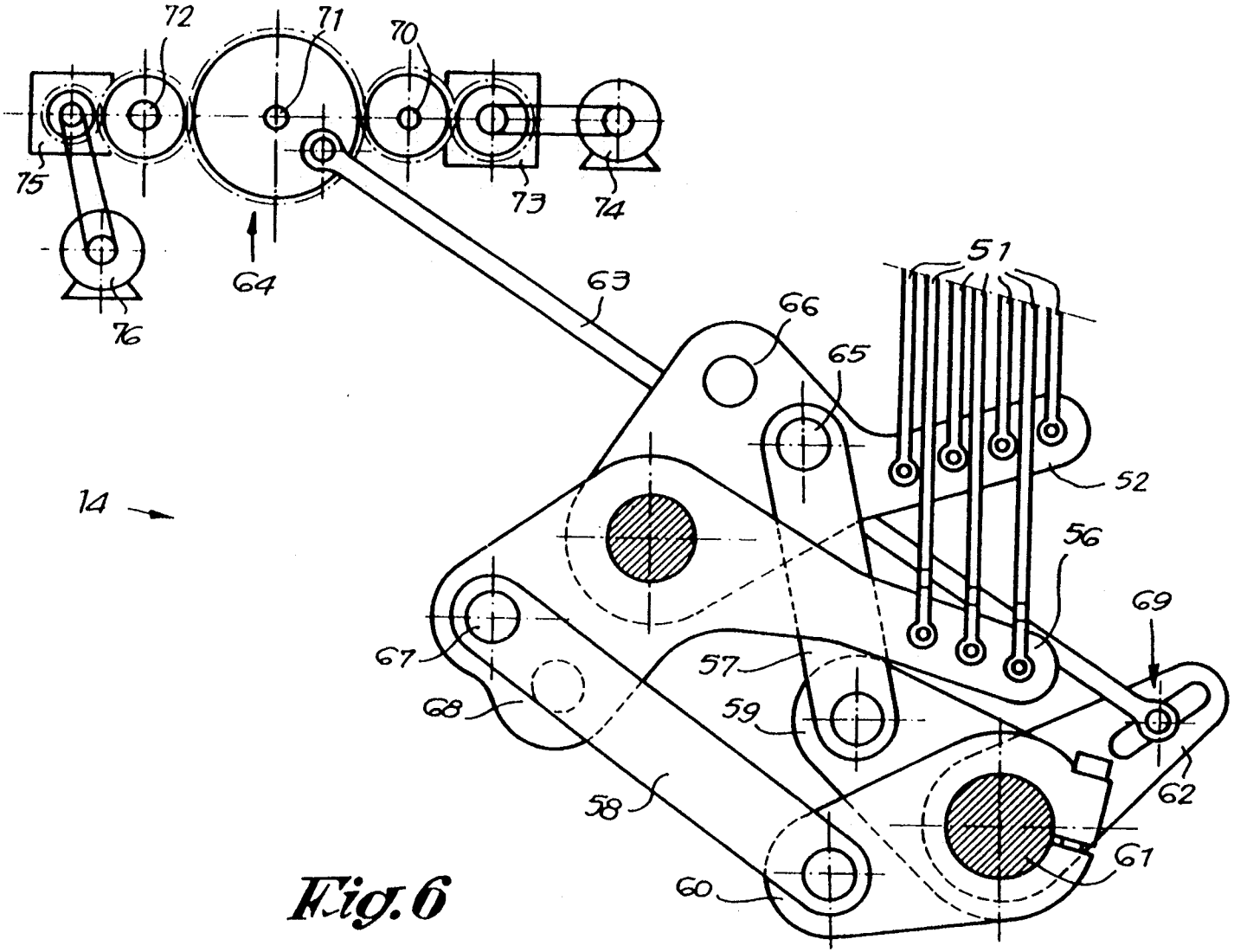
FIG. 6 shows an embodiment of the drive means of the device according to the invention.

FIG. 4 shows only one element 51 and one lever arm 52. However, several elements 51 can be coupled to the lever arm 52 in order to move different harnesses 11 at the same time. In addition, as shown in FIG. 6, a second lever arm 56 is provided on either side of the harnesses 11 which makes an opposite movement in relation to lever arm 52, so as to drive those harnesses 11 which move in an opposite direction relative to the harnesses 11 which are coupled to the lever arms 52.

The drive of the lever arms 52 and 56 can be done arbitrarily. For the sake of completeness an example is shown in FIG. 6.

The lever arms 52 and 56 are driven in opposite directions via connecting rods 57 and 58 by means of cranks 59 and 60 which are fixed to a turnable shaft 61. The shaft 61 is moved to and fro by means of a crank 62 and a rod 63 which is connected to a crank mechanism 64.

The rods 57 and 58 can be coupled in various places, 65-66 ana 67-68 respectively, to the lever arms 52 and 56. In addition, the cranks 59 and 60 can be fastened to the shaft 61 at various angles. By switching the rods 57 and 58 or replacing them by others and by turning the cranks 59 and 60 in relation to the shaft 61, another type of motion can be obtained for the harnesses 11 which can provide for a symmetrical as well as an asymmetrical movement. In other words, the crossing line of the warp threads 3 can be made to either coincide or not coincide with the above-mentioned weaving surface 21.

The course of the cranks 59, 60 and 62 can be changed by means of setting means 69.

As shown in FIG. 6, use can hereby be made of a weaving machine with three drive shafts 70, 71 and 72, which in the example shown are coupled such that the middle shaft 71 turns half as fast as the two other shafts 70 and 72.

The middle shaft 71 drives the crank mechanism 64. The shaft 70 provides for the drive of the sley 6.

In the example shown, the shaft 70 is driven via a main clutch 73 by a main drive motor 74. The shaft 72 can also be driven via a slow motion clutch 75 by means of an auxiliary drive motor 76, whereby the clutch 73 is declutched.

According to a variant, the auxiliary drive motor 76 and the slow motion clutch 75 are not present.

According to yet another variant, the main drive motor 74 is coupled directly to the shaft 72, without making use of a main clutch 73, an auxiliary drive motor 76 and a slow motion clutch 75.

It is clear that for driving the harnesses 11 it is not necessary to make use of the mechanism shown in FIG. 6, as other means can be used to the same effect. These means may for example consist of a classic dobby, an outside cam motion or a jacquard mechanisms and can for example be coupled to the shaft 72 via a pick find clutch and a transmission. The pick find clutch may be situated at the height of the slow motion clutch 75, as shown in FIG. 6, such that the auxiliary drive motor 76 can either drive only the means for the drive of the harnesses 11 via the slow motion clutch 75, or the entire weaving machine via the above-mentioned pick find clutch.

According to a variant, the main drive motor 74 can also be coupled directly to the above-mentioned means for the drive of the harnesses 11 and provide for the drive of the entire weaving machine via the above-mentioned pick find clutch.

It is clear that the present invention also concerns a device whereby the above-mentioned coupling elements, with which the harnesses are coupled to their drive means, are of another type than those shown in the figures, for example of the type whereby the coupling elements are fixed to the drive means 14.

The present invention is in no way limited to the embodiment described by way of example and shown in the accompanying drawings; on the contrary, such a device for forming a shed in weaving machines can be realized in various forms and dimensions while still remaining within the scope of the invention.

We claim:

1. A device for forming a shed in weaving machines, including drive means and a harness assembly, said harness assembly comprising a harness element which includes a side beam and coupling means made of first and second coupling elements for coupling the harness element to the drive means, the improvement comprising setting means at the side beam of the harness element for enabling individual height adjustment of the harness element relative to one of the coupling elements, wherein the setting means comprises a setting screw, wherein the second coupling element of the harness element is disposed at an end of the setting screw and is movable relative to the side beam in response to movement of the setting screw; and wherein the second coupling element located at the end of the setting screw is formed of a first part and a second part broader than the first part, the second part engaging the first coupling element which is discrete from the second coupling element to couple the harness to the drive means.

2. A shed forming device according to claim 1, wherein the coupling elements are disposed at the bottom of the harness element.

3. A shed forming device according to claim 1, wherein the first coupling element is fixed to said drive means, said first coupling element comprising a hook including a fork-shaped part; wherein the second coupling element is fixed to the setting means; and wherein the first part of the second coupling element fits into the fork-shaped part, the second part being connected to the first part and engaged in said hook.

4. The shed forming device according to claim 1, wherein the setting screw is integrated into the side beam of the harness element.

5. The shed forming device according to claim 1, wherein the setting screw extends from the top of the harness element and is accessible to a weaving machine operator and provided with means for enabling the operator to turn the setting screw.

6. In a device for forming a shed in weaving machines, including drive means and a harness assembly comprising a harness element, the harness element including a side beam, the improvement comprising:

coupling means for permitting the harness element to be coupled to the drive means and uncoupled from the drive means by moving the harness element sideways relative to a direction of weaving;

said coupling means including a first coupling element which is connected with the drive means and a second coupling element which is connected to the harness element;

and setting means at the side beam of the harness element for enabling individual height adjustment of the harness element relative to the second coupling element.

7. A shed forming device according to claim 6, wherein said first coupling element includes a support plane at a fork-shaped hook and said second coupling element is formed by a first part at the bottom end of each setting screw and a second, broader part, whereby said second coupling element can be placed on the support plane and can be moved sideways over this support plane and into the above-mentioned fork-shaped hook.

8. A shed forming device according to claim 6 or 7, further comprising a second harness element and means for moving the first and second coupling elements sideways relative to the weaving direction and to each other to effect coupling of the harness elements relative to each other.

9. A shed forming device according to claim 7, wherein said second coupling element is mounted on a part which can be moved in a guide piece, and wherein said part is driven by an element which is coupled to a lever arm, via a bendable leaf, to compensate for the sideways movement.

10. A shed forming device according to claim 6, wherein the harness element includes means for being movable in a guide element which is adapted to be mounted in a detachable part of the weaving machine.

11. In a device for forming a shed in weaving machines, including driving means and a harness assembly comprising a harness element, the harness element including a side beam, the improvement comprising:

coupling means for permitting the harness element to be coupled to the drive means and uncoupled from the drive means, said coupling means including a coupling element which is connected to the harness element and is located at the bottom of the harness element;

setting means at the side beam of the harness element for enabling individual height adjustment of the harness element relative to the coupling element;

said setting means comprising a setting screw which is threaded into the side beam of the harness element, the coupling element of the harness element being disposed at an end of the setting screw.

12. A harness assembly comprising a harness element, the harness element including a side beam, the improvement comprising:

coupling means for coupling the harness element to a harness drive, said coupling means including a coupling element which is respectively connected to the harness element and is located at a bottom of the harness element;

setting means at the side beam of the harness element for enabling individual height adjustment of the harness element relative to the coupling element;

said setting means comprising a setting screw which is threaded into the side beam of the harness element, the coupling element of the harness element being disposed at an end of the setting screw.

13. A shed forming device according to claim 12, wherein said second coupling element is mounted on a part which can be moved in a guide piece, and wherein said part is driven by an element which is coupled to a lever arm, via a bendable leaf, to compensate for the sideways movement.

* * * * *